United States Patent [19]

Bowden et al.

[11] Patent Number: 4,833,439

[45] Date of Patent: May 23, 1989

[54] UNITARY SWITCH AND CIRCUIT BREAKER

[75] Inventors: Wade R. Bowden, Northport; Emma Levin, Brooklyn, both of N.Y.

[73] Assignee: Slater Electric, Inc., Glen Cove, N.Y.

[21] Appl. No.: 132,947

[22] PCT Filed: Jul. 24, 1986

[86] PCT No.: PCT/US86/01545

§ 371 Date: Sep. 15, 1987

§ 102(e) Date: Sep. 15, 1987

[87] PCT Pub. No.: WO87/03421

PCT Pub. Date: Jun. 4, 1987

[51] Int. Cl.[4] ..... H01H 71/16

[52] U.S. Cl. ..... 337/68; 337/66; 337/56; 337/91

[58] Field of Search ..... 337/68, 66, 56, 91

[56] References Cited

U.S. PATENT DOCUMENTS

| | | | |
|---|---|---|---|
| 3,386,061 | 5/1968 | Delafrange | 337/68 |
| 4,363,016 | 12/1982 | Unger | 337/56 |
| 4,528,538 | 7/1985 | Andersen | 337/43 |
| 4,630,020 | 12/1986 | Yang | 337/68 |

*Primary Examiner*—H. Broome

*Attorney, Agent, or Firm*—Morgan & Finnegan

[57] ABSTRACT

A unitary switch and circuit breaker (10) includes a switch circuit (14, 16, 22, 24, 26, 56, 57, 58) with first and second contacts (28, 30), the switch circuit (14, 16, 22, 24, 26, 56, 57, 58) being actuable to assume a first condition (FIG. 4) in which the contacts (28, 30) are open and a second condition (FIG. 5) in which the contacts (28, 30) are closed, and a circuit breaker (24, 26, 32, 42, 56, 57) integrally formed with the switch circuit (14, 16, 22, 24, 26, 56, 57, 58) for actuating the contacts (28, 30) to interrupt current flow through the contacts (28, 30) in response to the current flow exceeding a predetermined level and for subsequently preventing the resumption of current flow through the contacts (28, 30) until reset.

29 Claims, 5 Drawing Sheets

UNITARY SWITCH AND CIRCUIT BREAKER

TECHNICAL FIELD

This invention relates to electrical switches and circuit breakers, and more particularly, to a combination switch and circuit breaker.

BACKGROUND ART

Circuit breakers are used in a wide variety of electronic systems in which components must be protected from large currents such as those that accompany circuit malfunctions or external power surges. A circuit breaker is connected between the source of power and the components to be protected, and contains a component that trips when excessive current flows through it, opening the circuit through the circuit breaker and disconnecting the source of power from the components to be protected. Electronic systems frequently include on and off switches connected in series with the circuit breaker for turning on or off the electronic system. Frequently, separate switches and circuit breakers are used in electronic systems. Since two units are used, a relatively large amount of space is required to accommodate both units.

A combined switch and circuit breaker unit is disclosed in U.S. Pat. No. 4,528,538 to Andersen. This is a single unit and is adapted so that after interruption of the current flow by the circuit breaker, opening the switch circuit resets the circuit breaker. In Andersen, however, the switch and circuit breaker are electrically separate units and are not unitary. The Andersen device is not very compact since the switch and circuit breaker are electrically separate units. The Andersen device is also relatively expensive to manufacture since it is relatively complex, and comprises numerous parts.

OBJECTS AND SUMMARY OF THE INVENTION

It is thus an object of the present invention to overcome the aforesaid defects of the prior art.

It is another object of the present invention to provide a unitary switch and circuit breaker.

It is also an object of the present invention to provide a unitary switch and circuit breaker that reduces the number of components used to perform both the switching function and the circuit breaker function.

It is still a further object of the present invention to provide a unitary switch and circuit breaker in which the two functions are performed in a single unit.

It is yet another object of the present invention to provide a unitary switch and circuit breaker that is small in size and relatively compact.

It is still a further object of the present invention to provide a unitary switch and circuit breaker that indicates when the circuit breaker function has been actuated.

It is yet a further object of the present invention to provide a unitary switch and circuit breaker in which the circuit breaker places the switch in the off position when the circuit breaker is actuated.

It is an even further object of the present invention to provide a unitary switch and circuit breaker in which placing the switch in the "on" condition simultaneously resets the circuit breaker function.

In accord with the present invention, a unitary switch and circuit breaker includes switch means having first and second contact means, the switch means actuable to assume a first condition in which the contact means are open and a second condition in which the contact means are closed, and breaker means integral with the switch means for actuating the contact means to interrupt current flow through the contact means in response to the current flow exceeding a predetermined level and for subsequently preventing the resumption of current flow through the contact means until reset.

As preferably embodied, one set of electrical contacts are operated by both the switch means and the breaker means.

The above, and other objects, features and advantages of the present invention will be apparent from the following detailed description of illustrative embodiments thereof which is to be read in connection with accompanying drawings.

DETAILED DESCRIPTION

Figure 1:
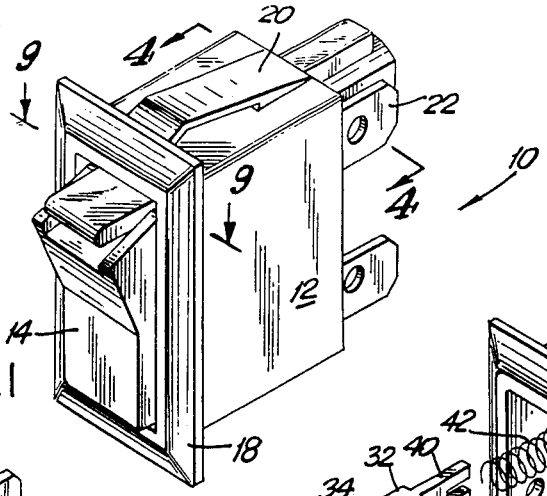
FIG. 1 is a perspective view of an embodiment of a unitary switch and circuit breaker in accord with the present invention.
Figure 2:
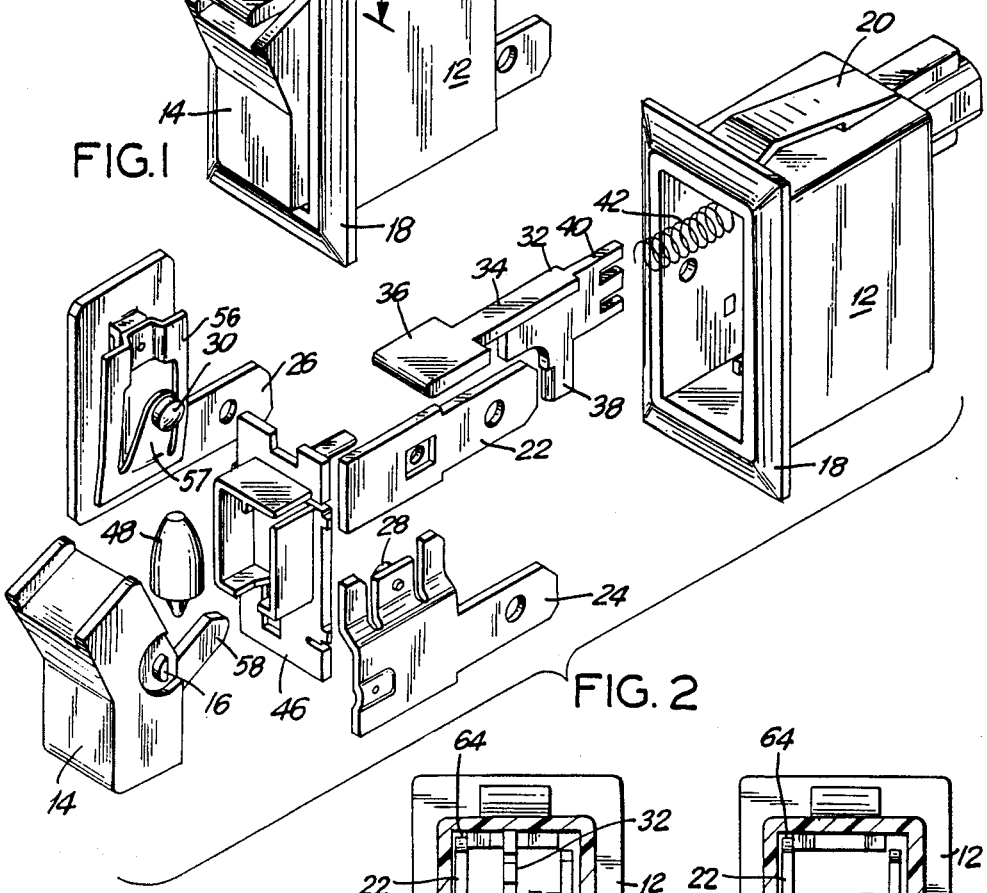
FIG. 2 is an exploded, perspective view illustrating the component parts of the embodiment of FIG. 1.
Figure 3:
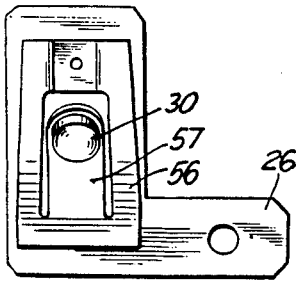
FIG. 3 is a plan view of a terminal lug of the embodiment of FIG. 1 illustrating a thermally sensitive bimetallic strip.

Referring to the drawings, and initially to FIGS. 1 through 3 thereof, an embodiment of a unitary switch and circuit breaker 10 is disclosed. Device 10 includes a housing 12 for containing the electrical contacts and other elements of the device, as more fully discussed hereinbelow. A rocker arm 14 is pivotally mounted on pivot 16 in housing 12. As will be apparent from the following description, device 10 has at least two functions: a switching function and a circuit breaker function. When the switching function of device 10 is utilized, rocker arm 14 pivots between an "on" and an "off" position in which electricity flows or does not flow, respectively, through device 10. When the circuit breaker function is utilized, device 10 can assume a circuit "open" or a circuit "closed" condition in which electricity does not flow or does flow, respectively, through device 10. The two functions are integral to device 10, and the parts or elements of the illustrated embodiments cooperate to perform the described functions.

A facing 18 surrounds rocker arm 14 and provides a portion of the mounting structure for device 10. A pair of retaining arms 20 extend from the lateral edges of housing 12 for elastically cooperating with a mounting surface to retain device 10 therein. For example, device 10 might be inserted through an opening formed in a flat plate or the like (not shown), with retaining arms 20 flexed to retain device 10 in the opening.

Referring to FIG. 2, device 10 includes an upper terminal lug 22, and a pair of lower terminal lugs 24, 26. As is evident to those of skill in the art, lugs 22, 24, 26 provide electrical connections for device 10. Lower lugs 24, 26 have associated therewith first and second electrical contacts 28, 30, respectively. As discussed more fully hereinbelow, first and second contacts 28, 30 provide electrical switching contacts for the switching function of device 10. A reset element 32 is provided for resetting the circuit breaker function of device 10. Reset element 32 has as an integral part thereof a projecting arm 34 with a tab 36 formed on the end. Reset element 32 also includes a non-conducting area or portion 38 that blocks the flow of current between contacts 28, 30, as will be discussed more fully hereinbelow. Reset element 32 also includes a toothed-portion 40 for cooperating with a spring 42. Spring 42 cooperates with a back wall of device 10 to bias reset element 32 to block the flow of current between contacts 28, 30. Apertures (not shown) are formed in the back wall so that lugs 22, 24 and 26 can project therefrom in the form of male contact blades. The back wall includes a projecting portion 44 to receive spring 42 and reset element 32. Lug 22 provides an electrical connection for a pilot lamp 48. Lamp 48 is positioned in a cradle 46 that fits within rocker arm 14. In the preferred embodiment, rocker arm 14 is made of a transparent or translucent material, such as plastic, whereby lamp 48 is visible. Also in the preferred embodiment, lamp 48 is illuminated when rocker arm 14 is placed in the switch "on" condition, and is not illuminated when rocker arm 14 is placed in the switch "off" condition, or if the circuit breaker function has been actuated (even if rocker arm 14 is in the "on" condition).

FIG. 3 illustrates a bimetallic strip 56 associated with lug 26. Bimetallic strip 56 is a thermally sensitive bimetallic strip with a tongue 57 coupled to lug 26 for mounting contact 30. Such a bimetallic strip can be, for example, a so-called Taylor-type bimetallic strip such as disclosed in U.S. Pat. No. 4,379,278 to Kuczynski et al. Strip 56 is made of a flexible, spring-like material in which a U-shaped cut-out is made from tongue 57 which carries contact 30. As is evident to those with skill in the art, when an overload occurs, strip 56 heats up until tongue 57 snaps back to buckle over the switch center resulting in an instantaneous displacement of the tongue 57 to separate contact 28 on lug 24 from contact 30 on tongue 57.

Figure 4:
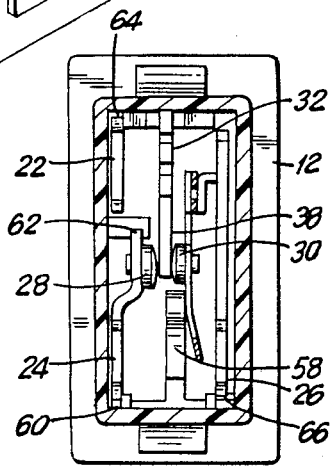
FIG. 4 is a cutaway plan view of the reverse side of the embodiment of FIG. 1 showing the contacts in the open condition.

FIG. 4 illustrates an embodiment of the device of the present invention in which rocker arm 14 has been pivoted so that contacts 28, 30 are in the open condition. Referring briefly to FIG. 2, rocker arm 14 includes an actuating arm 58 projecting therefrom. Arm 58 projects through a hole or an aperture in cradle 46 to engage bimetallic strip 56. The pivotal action of rocker arm 14 causes bimetallic strip 56 to move rightward in the illustrated embodiment to open contacts 28, 30.

In the embodiment of FIG. 4, lug 24 is positioned in slots or grooves 60, 62 formed in housing 12. Lug 22 is disposed in a groove or slot 64 in housing 12. Lug 26 is disposed in a groove or slot 66 in housing 12.

Figure 5:
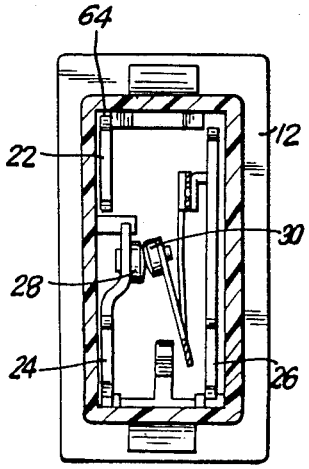
FIG. 5 is a cutaway plan view of the reverse side of the embodiment of FIG. 1 showing the contacts in the closed condition.

In FIG. 5, reset element 32 is not positioned between contacts 28, 30, as rocker arm 14 is placed in the "on" condition.

The operation of the circuit breaker feature of the illustrated embodiment is next to be described.

When a current surge occurs, and the current supplied to device 10 exceeds a predetermined threshold, bimetallic strip 56 is actuated to separate contacts 28, 30. When the surge occurs, tongue 57 bends enough to buckle over and move contact 30 to the right, as seen in FIGS. 4 and 5, whereby non-conducting portion 38 of reset element 32 is urged into a blocking position between contacts 28, 30 by the biasing action of spring 42.

Assuming that the external power surge is no longer present, displacement of reset element 32 will displace non-conducting portion 38 from a position between contacts 28, 30 whereby current can again flow through contacts 28, 30. Non-conducting portion 38 is returned to its abutting position with contacts 28, 30.

The operation of the switching feature of device 10 is next to be described.

As illustrated in FIG. 4, when rocker arm 14 is placed in the "off" condition, projecting arm 58 engages tongue 57 and laterally displaces it to the right. The lateral displacement of tongue 57 separates contacts 28, 30, thus breaking the flow of current therethrough. Spring 42 biases non-conducting portion 38 of reset element 32 between contacts 28, 30.

Pivotal movement of rocker arm 14 to the "on" condition causes projecting arm 58 to disengage from cam element 59, so that the spring action of tongue 57 returns tongue 57 to its prior position. At this point, non-conducting portion 38 of reset element 32 is still between contacts 28, 30. Tab 36 must next be depressed to displace non-conducting portion 38 from between contacts 28, 30. Tongue 57 then bends over whereby contacts 28, 30 meet. FIG. 5 illustrates device 10 with rocker arm 14, and hence device 10, in the "on" condition. In FIG. 5, reset element 32, and arm 58 have been omitted for ease of illustration.

Figure 6:
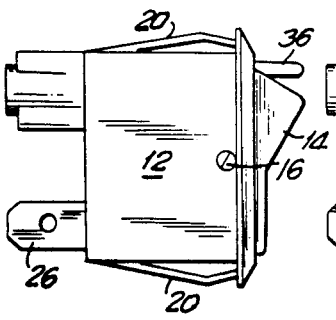
FIG. 6 is a side view of the embodiment of FIG. 1 showing the switch function in the off condition and the circuit breaker function in the open condition.

FIGS. 6 through 9 illustrate the indicator function of an embodiment of the present invention wherein tab 36 extends outwardly from housing 12 through a slot or groove 68 formed on a lateral edge of rocker arm 14. As illustrated most clearly in FIG. 6, when the circuit breaker function of the device 10 has been actuated, and contacts 28, 30 are in the open position, so that no current flows through device 10, tab 36 extends beyond housing 12 visually to indicate that the circuit breaker function of the device is in the "open" condition. In FIG. 6, the switching function of device 10 is in the "off" condition, that is, contacts 28, 30 are separated by a gap or space so that no current can flow therethrough.

Figure 7:
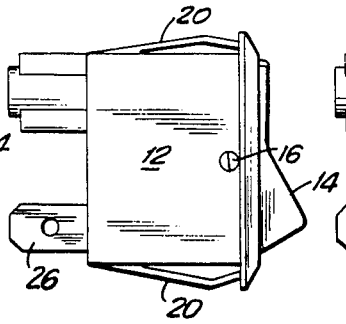
FIG. 7 is a side view of the embodiment of FIG. 1 illustrating the switch function in the on condition and the circuit breaker function in the closed condition.

In FIG. 7, tab 36 does not extend from housing 12 since the circuit breaker function is in the "closed" condition. Rocker arm 14 of device 10 is in the "on" condition.

Figure 8:
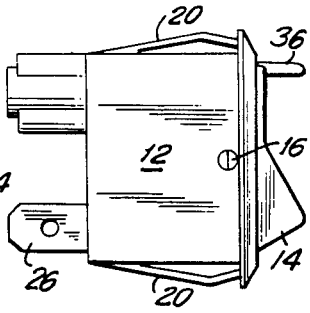
FIG. 8 is a side view of the embodiment of FIG. 1 illustrating the switch function in the on condition and the circuit breaker function in the open condition.

In FIG. 8, the circuit breaker function is in the "open" condition, but rocker arm 14 is in the "on" condition. In the illustrated embodiment, tab 36 extends beyond housing 12, visually indicating that the circuit breaker function of device 10 has been actuated and contacts 28, 30 are open. It is to be noted that in the embodiment of FIG. 8, contacts 28, 30 are open, even though rocker arm 14 is in an "on" condition, whereby contacts 28, 30 would be closed. In the illustrated embodiment, non-conducting portion 38 of reset element 32 is disposed between contacts 28, 30, effectively preventing the flow of current therethrough.

Figure 9:
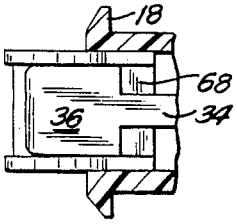
FIG. 9 is a view taken along the line 9—9 of FIG. 1.

FIG. 9 illustrates slot or groove 68 in rocker arm 14 through which tab 36 projects from housing 12.

Figure 10:
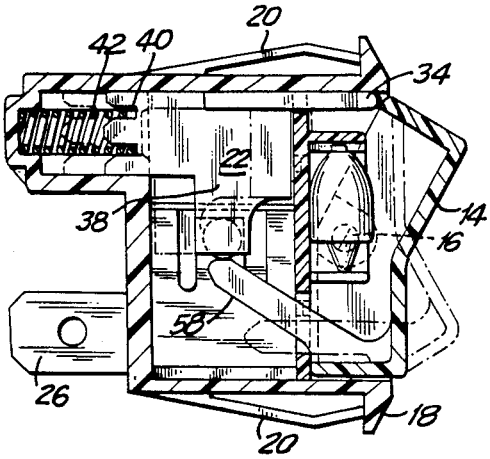
FIG. 10 is a cutaway side view of an alternate embodiment of the present invention.

FIG. 10 illustrates an alternate embodiment of the present invention in which tab 36 is not included as a portion of reset element 32. Rather, projecting arm 34 of reset element 32 engages the lower edge of rocker arm 14. In the illustrated embodiment, when the circuit breaker function of device 10 has been tripped, and is in the "open" condition, displacement of reset element 32 will pivot rocker arm 14 into the "off" position. Conversely, pivotal movement of rocker arm 14 will displace reset element 32 and non-conducting portion 38 from its blocking position between contacts 28, 30. Thus, turning "on" device 10 automatically resets the circuit breaker function of the device. Conversely, operation of the circuit breaker function of device 10 provides a visual indication of such actuation because rocker arm 14 is moved to the "off" position. However, it is to be noted that, in the embodiment of FIG. 10, an operator cannot determine whether device 10 is in the "off" position because the circuit breaker function of the device has been actuated, or because the device 10 has simply been placed in the "off" position.

Figure 11:
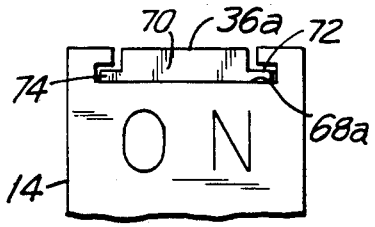
FIG. 11 is a partial, plan view of a rocker arm and tab in an embodiment of the present invention.
Figure 12:
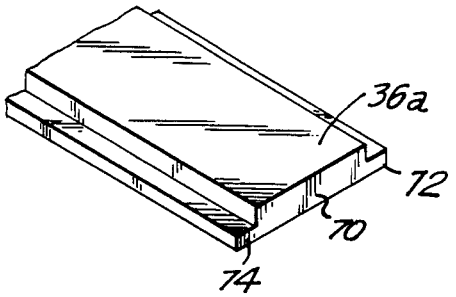
FIG. 12 is a partial, perspective view of the tab of FIG. 11.

In the embodiment of FIGS. 1 through 9, tab 36 has a substantially rectangular cross-section that cooperates with a similarly shaped groove 68 in rocker arm 14. Other cross-sectional shapes of tab 36 are possible. For example, as illustrated in FIGS. 11 and 12, tab **36*a* can have a straight dove-tail shape. Dove-tail tab 36*a* of FIGS. 11 and 12 comprises a substantially rectangular-shaped central portion 70 with shoulder-shaped portions 72, 74 extending laterally therefrom. In tab 36*a* of FIGS. 11 and 12, substantially rectangular shoulder portions 72, 74, along with substantially rectangular central portion 70, are dimensioned to give tab 36*a*** a substantially "flattened" appearance.

Figure 13:
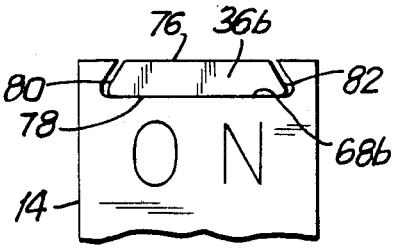
FIG. 13 is a partial, plan view of another rocker arm and tab in an embodiment of the present invention.
Figure 14:
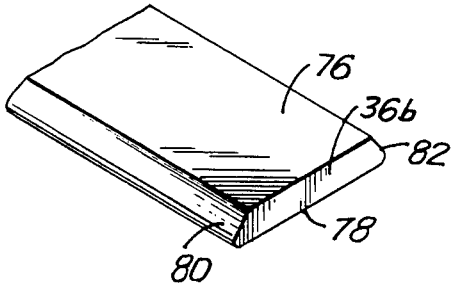
FIG. 14 is a partial, perspective view of the tab of FIG. 13.

FIGS. 13 and 14 illustrate a tab **36*b* with an angular dove-tail shape. Tab 36*b* cooperates with a similarly shaped groove 68*b* in rocker arm 14. As illustrated most clearly in FIG. 14, tab 36*b* has an upper flat surface 76, a lower, flat, plane surface 78, and two slanted faces 80, 82. In tab 36*b*, faces 76, 78 are substantially larger than faces 80, 82, thus giving tab 36*b*** a "flattened" shape.

It is to be appreciated that, with tabs **36*a*, 36*b* configured as in FIGS. 11 through 14, tabs 36*a*, 36*b* are held more securely in slots 68*a*, 68*b*, than is the case in the embodiment of FIGS. 1 through 9. More particularly, tab 36 is free to be displaced from slot 68 (see FIG. 9) while tabs 36*a*, 36*b* are constrained within slots 68*a*, 68*b* due to the shape of tabs 36*a*, 36*b* and the cooperating shapes of slots 68*a*, 68*b*. Thus, tabs 36*a*, 36*b* follow the arc of travel of rocker arm 14 when switch 10 is placed in the switch "off" condition. This assures a one-motion reset of the circuit breaker function when rocker arm 14** is placed in the "on" condition.

FIGS. 15–21 illustrate another preferred embodiment of the present invention. This embodiment is particularly advantageous in ensuring that the condition of the switch fully corresponds to the "on ", "off" indication provided by the rocker arm 14 and that the switch is always in the "off" condition when the rocker arm is in the "off" position. To this end, the embodiment of FIG. 15 includes a spring 49 disposed between cradle 46' and rocker arm 14 to bias rocker arm 14 into the full "on" position. A user can thus readily ascertain that the switch is "on" if the flag 36 remains withdrawn or "off" if the flag is projecting upwardly through the slot formed at the end of the rocker.

Figure 15:
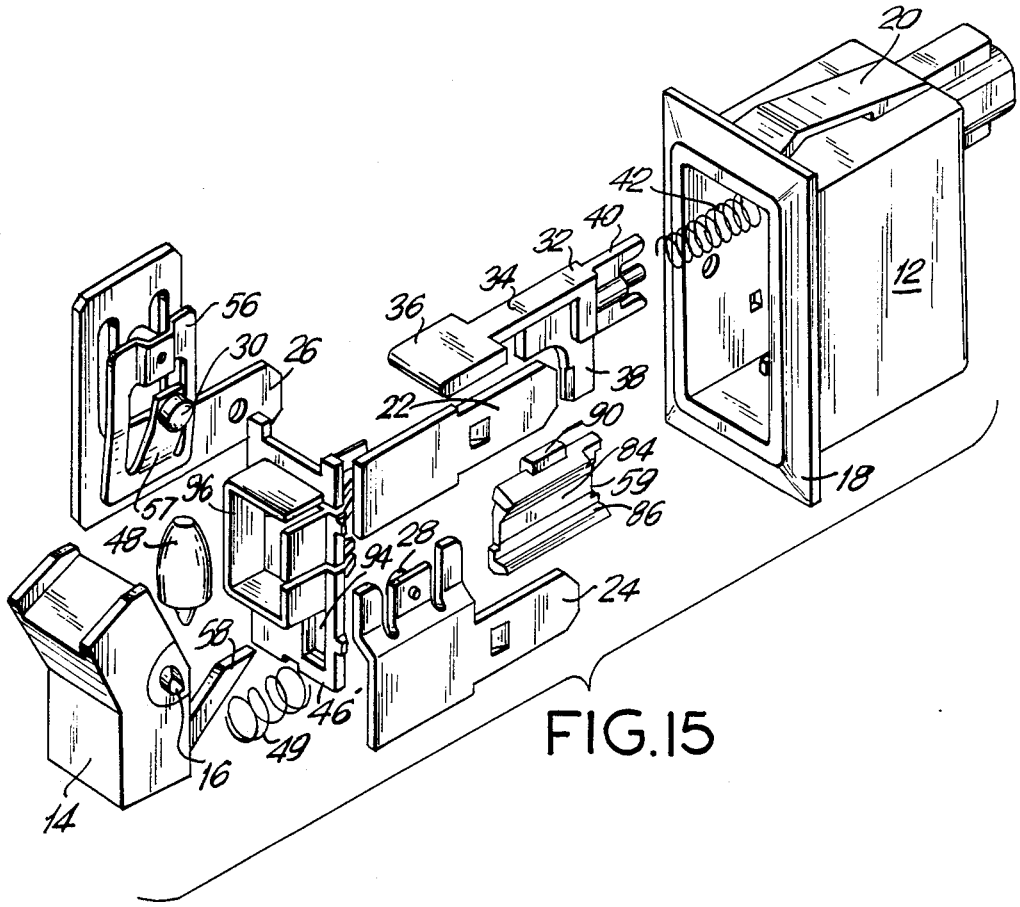
FIG. 15 is an exploded, perspective view illustrating the component parts of another embodiment of the present invention.
Figure 16:
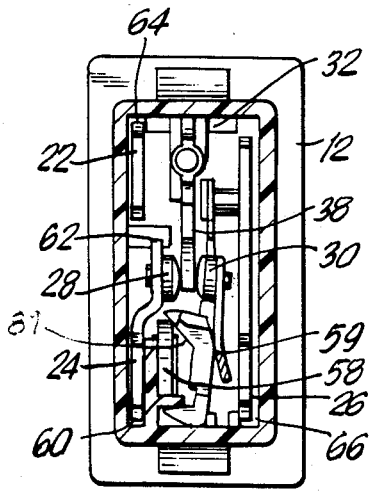
FIG. 16 is a cutaway view of the reverse side of the embodiment of FIG. 15 showing the contacts in the open condition.
Figure 17:
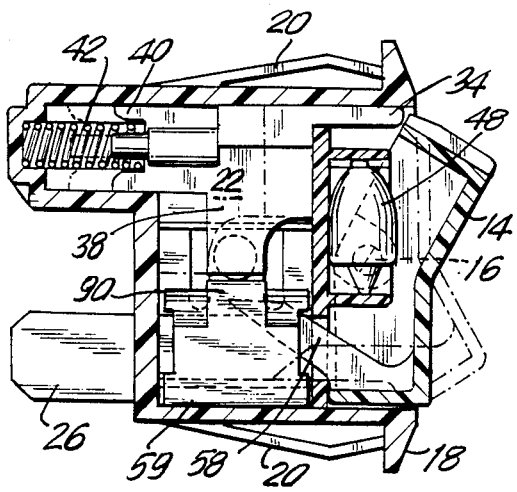
FIG. 17 is a cutaway side view of the embodiment of FIG. 15.

This embodiment further advantageously includes a cam element (indicated at 59) within housing 10 in operative association with arm 58 and tongue 57 of bimetallic strip 56 for "tripping" the switch in response to movement of rocker arm 14. (It will be understood that in FIG. 15, cam element 59 becomes positioned between slot 94 and arm 57). In the embodiment of FIG. 15, cam element 59 is preferably made of a heat resistant material such as a thermoset resin or other plastic of high temperature deformation characteristics, as can be reset element 36. By making cam element 59 (and reset element 32) of such a heat-resistant plastic, damage to any of the operative elements from heat generated during, e.g., a short circuit can be avoided. At the same time the remaining parts (such as rocker arm 14 and arm 58) can be economically fabricated from other materials since high heat resistence is not necessarily essential.

Figure 18:
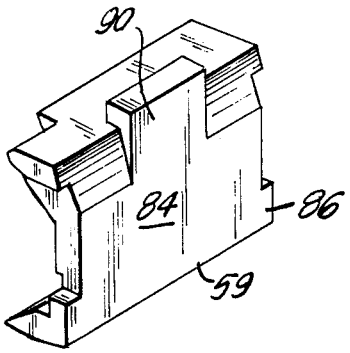
FIG. 18 is a perspective view of a cam element of the embodiment of FIG. 15.

FIG. 18 illustrates cam element 59 in greater detail. Cam element 59 includes a substantially planar body portion 84 with a foot 86. As illustrated most clearly in FIGS. 19 and 21, foot 86 engages slot 88 in housing 12 to form a floating pivot mounting within the housing for allowing the cam to pivot in response to movement of arm 58 against its canted surfaces 89. (The floating pivot mounting facilitates the assembly operation by avoiding the need for, e.g., close tolerances in aligning pins.) Cam element 59 also includes a projecting portion 90 that extends slightly beyond planar body portion 84. Projecting portion 90 will engage tongue 57 of bimetallic strip 56 to "trip" the circuit.

Figure 19:
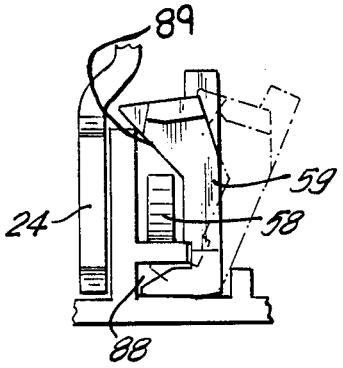
FIG. 19 is a detailed view of the housing of the embodiment of FIG. 15 illustrating the pivoting action of the cam element of FIG. 18.

FIG. 19 illustrates the pivoting action of cam element 59 in response to movement of rocker arm 14 and arm 58. Movement of arm 58 against canted surface 89 causes cam element 59 to rotate in pivotal fashion from the "on" position, indicated in full lines, to the "off" position, indicated in phantom lines.

Figure 20:
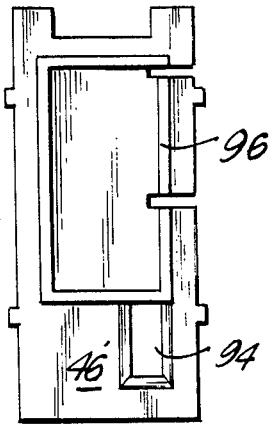
FIG. 20 is a plan view of the cradle of the embodiment of FIG. 15.
Figure 21:
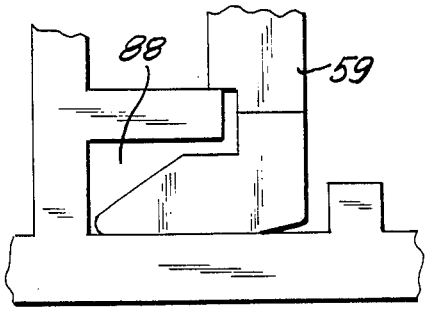
FIG. 21 is a detailed view of a slot in the housing of the embodiment of FIG. 15.

FIG. 20 illustrates cradle 46' used in the embodiment of FIG. 15. Cradle 46 (FIGS., 1–14), it will be recalled, is used to provide a pivot point for cam element 59 and a fixed point for spring 49. Cradle 46 is provided with an aperture 94 for arm 58. In the embodiment of FIG. 15, aperture 94 is displaced from the left side to the right side of cradle 46', as compared with the location of the aperture in cradle 46 of the embodiment of FIG. 1. This displacement permits the addition of cam element 59 and acts to accommodate arm 58 which must likewise be displaced on rocker 14 to allow the location of the operative association with the cam element 59. Lamp 48 is disposed in rectangular compartment 96.

It is to be appreciated from the above description of the preferred embodiments that a unitary switch and circuit breaker in accord with the present invention is particularly compact, especially because only a single pair of contacts are included therein and are used for both the switching function and the circuit breaker function.

Although illustrative embodiments of the present invention have been described in detail herein with reference to the accompanying drawings, it is to be understood that the invention is not limited to those precise embodiments, and that various changes and modifications may be effected therein by one skilled in the art without departing from the spirit and scope of the invention as defined in the appended claims.

I claim:

1. A device comprising:

a pair of contact members;

switching means for actuating said contact members to assume a first condition in which said contact members are open and a second condition in which said contact members are closed; and breaker means disposed within said device to interrupt current flow through said contact members in response to said current flow exceeding a predetermined level and in response to actuation of said switching means to open said contact members, said breaker means including non-conducting means for interposing between said contact members to subsequently prevent the resumption of flow until rest, switching means translatable when desired to a first position so as to open said contact members, said breaker means adapted to essentially immediately cause said non-conducting means to interpose between said first and second contact means in response to translating said switching means to said first position.

2. The device of claim 1; wherein said breaker means includes reset means for resetting said breaker means after said breaker means interrupts said current flow.

3. The device of claim 2; wherein said breaker device has only said first and second contact means.

4. The device of claim 2; wherein said breaker means includes biasing means for normally biasing said non-conducting means to interrupt said current flow.

5. The device of claim 4; wherein said biasing means is a spring.

6. The device of claim 2; and further comprising indicating means for indicating when said breaker means has been actuated.

7. The device of claim 6; wherein said indicating means is coupled to said reset means; and wherein actuation of said indicating means actuates said reset means.

8. The device of claim 7; wherein said indicating means includes a tab.

9. The device of claim 8; and further comprising housing means for containing said contact means, said switching means, said breaker means, and said reset means, said housing means dimensioned to be compact.

10. The device of claim 9; wherein said tab projects beyond said housing means to visually indicate that said breaker means has bene actuated.

11. The device of claim 9; wherein said switching means includes rocker arm means pivotally mounted in said housing means for actuating said contact means.

12. A device comprising:

a pair of contact members;

switching means for actuating said contact members to assume a first condition in which said contact members are open and a second condition in which said contact members are closed;

breaker means for actuating said contact members to interrupt current flow through said contact members in response to said current flow exceeding a predetermined level, said breaker members including non-conducting means for interposing between said contact members to subsequently prevent resumption of current flow until reset, said breaker means further including reset means for resetting said breaker means after said breaker means interrupts said current flow;

indicating means for indicating when said breaker means has been actuated, said indicating means being coupled to said reset means and cooperating with said reset means such that actuation of said indicating means actuates said reset means, said indicating means including a tab member thereon;

housing means for containing said contact members, said switching means, said breaker means, and said reset means, said housing means dimensioned to be compact; and said switching means including rocker arm means pivotally mounted in said housing means for actuating said contact members, said rocker arm means including a groove formed on an edge thereof and dimensioned to permit said tab to project therethrough.

13. The device of claim 12; wherein said tab has a polygonal cross-section, and said groove has a corresponding cross-section to receive said tab.

14. The device of claim 12; wherein said tab has a rectangular cross-section, and said groove has corresponding cross-section to receive said tab.

15. The device of claim 12; wherein said tab has a dove-tail shape, and said groove is correspondingly dimensioned to receive said tab.

16. The device of claim 12; wherein said tab has an angular dove-tail shape, and said groove is correspondingly dimensioned to receive said tab.

17. A device comprising:

a pair of contact members;

stitching means for actuating said contact members to assume a first condition in which said contact members are open and a second condition in which said contact members are closed;

breaker means for actuating said contact members to interrupt current flow through said contact members in response to said current flow exceeding a predetermined level, said breaker means including non-conducting means for interposing between said contact members to subsequently prevent resumption of current flow until reset, said breaker means a further including reset means for resetting said breaker means after said breaker means interrupts and current flow;

indicating means for indicating when said breaker means has been actuated, said indicating means being coupled to said reset means and cooperating with said reset means such that actuation of said indicating means actuates said reset means, said indicating means including a tab member thereon;

housing means for containing said contact members, said switching means, said breaker means, and said reset means, said housing means dimensioned to be compact; and said switching means including rocker arm means pivotally mounted in said housing means, said rocker arm means including a projecting arm coupled thereto for actuating said contact members.

18. A device comprising:

a pair of contact members;

switching means for actuating said contact members to assume a first condition in which said contact members are open and a second condition in which said contact members are closed, said switching means including a pivotally mounted cam means for actuating said first and second contact means to assume said first and second conditions;

breaker means for actuating said contact members to interrupt current flow through said contact members in response to said current flow exceeding a predetermined level, said breaker means including non-conducting means for interposing between said contact members to subsequently prevent resumption of current flow until reset, said breaker means further including rest means for resetting said breaker means after said breaker means interrupts said current flow;

indicating means for indicating when said breaker means has been actuated, said indicating means being coupled to said reset means and cooperating with said reset means such that actuation of said indicating means actuates said reset means, said indicating means including a tab member thereon;

housing means for containing said contact members, said switching means, said breaker means, and said reset means, said housing means dimensioned to be compact; and said switching means further including rocker arm means pivotally mounted in said housing, said rocker arm means cooperating with said cam means to actuate said contact members.

19. A device comprising:

a pair of contact members;

switching means for actuating said contact members to assume a first condition in which said contact members are open and a second condition in which said contact members are closed, said switching means including a pivotally mounted cam means for actuating said contact members to assume said first and second conditions;

breaker means for actuating said contact members to interrupt current flow through said contact members in response to said current flow exceeding a predetermined level, said breaker means including non-conducting means for interposing between said contact members to subsequently prevent resumption of current flow until reset, said breaker means further including reset means for resetting said breaker means after said breaker means interrupts said current flow;

indicating means for indicating when said breaker means has been actuated, said indicating means being coupled to said reset means and cooperating with said reset means such that actuation of said indicating means actuates said reset means, said indicating means including a tab member thereon;

housing means for containing said contact members, said switching means, said breaker means, and said reset means, said housing means dimensioned to be compact; and said switching means further including rocker arm means pivotally mounted in said housing, said rocker arm means including a projecting arm coupled thereto, said projecting arm engaging said cam means to pivot said cam means so as to actuate said contact members.

20. The device of claim 19; wherein said cam means includes an engaging portion for engaging one of said first and second contact means.

21. A device comprising:

a pair of contact members;

switching means for actuating said contact members to assume a first condition in which said contact members are open and a second condition in which said contact members are closed;

breaker means for actuating said contact members to interrupt current flow through said contact members in response to said current flow exceeding a predetermined level, said breaker means including non-conducting means for interposing between said contact members to subsequently prevent resumption of current flow until reset, said breaker means further including reset means for resetting said breaker means after said breaker means interrupts said current flow;

indicating means for indicating when said breaker means has been actuated, said indicating means being coupled to said reset means and cooperating with said reset means such that actuation of said indicating means actuates said reset means, said indicating means including a tab member thereon;

housing means for containing said contact members, said switching means, said breaker means, and said reset means, said housing means dimensioned to be compact; and said switching means including rocker arm means pivotally mounted in said housing means for actuating said contact members, said rocker arm means having a full "on" position corresponding to said contact members being in said second condition and a full "off" position corresponding to said contact members being in said first condition, said switching means including means for biasing said rocker arm means to a position between said full "on" and said full "off" positions when said rocker arm means has been actuated to said full "off" position but said contact members are in said second condition.

22. The device of claim 21; wherein said means for biasing includes a spring.

23. A device comprising:

a pair of contact members;

switching means for actuating said contact members to assume a first condition in which said contact members are open and a second condition in which said contact members are closed;

breaker means for actuating said contact members to interrupt current flow through said contact members in response to said current flow exceeding a predetermined level, said breaker means including non-conducting means for interposing between said contact members to subsequently prevent resumption of current flow until reset, said breaker means further including reset means for resetting said breaker means after said breaker means interrupts said current flow; and housing means for containing said contact members, said switching means, said breaker means, and said reset means, said switching means including rocker arm means pivotally mounted in said housing means for actuating said contact members, said reset means including means for cooperating with said rocker arm means to pivot said rocker arm means when said breaker means is actuated.

24. The device of claim 23; wherein said means for cooperating actuates said reset means when said rocker arm means is pivoted to close said contact means.

25. The device of claim 24; wherein said means for cooperating comprises an actuating arm integrally formed with said non-conducting means.

26. The device of claim 2; wherein said breaker means includes a thermally sensitive bimetallic strip with a tongue for pivotally mounting one of said first and second contact means on said tongue.

27. The device of claim 1; and further comprising lamp means for indicating the condition of said switching means.

28. The device of claim 1; and further comprising housing means or containing said containing means, said switching means, and said breaker means; and wherein said switching means includes rocker arm means pivotally mounted in said housing means, said rocker arm means including a projecting arm for actuating said contact means.

29. A unitary switch and circuit breaker comprising switch means having a pair of contact members, said switch means actuable to assume a first condition in which said contact members are open and a second condition in which said contact members are closed; breaker means integral with said switch means, said breaker means actuating said contact members to assume said first condition and interrupt current flow through said contact members in response to said current flow exceeding a predetermined level and in response to actuation of said switching means to open said contact members, said breaker means subsequently preventing the resumption of current flow through said contact members until reset; said switching means translatable when desired to a first position so as to open said contact members to assume said first condition; said breaker means adapted to essentially immediately interrupt said current flow in response to translating said switching means to said first position.

* * * * *